US007086323B2

(12) United States Patent
Watanabe et al.

(10) Patent No.: US 7,086,323 B2
(45) Date of Patent: Aug. 8, 2006

(54) SWASH PLATE COMPRESSOR

(75) Inventors: Satoshi Watanabe, Saitama (JP); Minoru Kanaizuka, Saitama (JP); Yasunori Fujita, Saitama (JP); Toshiaki Kuribara, Saitama (JO); Ryosuke Izawa, Saitama (JP)

(73) Assignee: Zexel Valeo Climate Control Corporation, Saitama (JP)

( * ) Notice: Subject to any disclaimer, the term of this patent is extended or adjusted under 35 U.S.C. 154(b) by 108 days.

(21) Appl. No.: 10/509,914

(22) PCT Filed: Nov. 17, 2003

(86) PCT No.: PCT/JP03/14566

§ 371 (c)(1),
(2), (4) Date: Oct. 4, 2004

(87) PCT Pub. No.: WO2004/092583

PCT Pub. Date: Oct. 28, 2004

(65) Prior Publication Data

US 2005/0115401 A1 Jun. 2, 2005

(30) Foreign Application Priority Data

Apr. 17, 2003 (JP) ..... 2003-112285

(51) Int. Cl.
*F01B 3/00* (2006.01)

(52) U.S. Cl. ..... 92/71

(58) Field of Classification Search ..... 74/60; 92/12.2, 70, 71
See application file for complete search history.

(56) References Cited

U.S. PATENT DOCUMENTS 4,734,014 A * 3/1988 Ikeda et al. ..... 92/71
6,276,905 B1 * 8/2001 Yoshitaka ..... 92/71
6,371,007 B1 * 4/2002 Ootsuki ..... 92/71
6,644,172 B1 * 11/2003 Nakayama et al. ..... 92/71

(Continued)

FOREIGN PATENT DOCUMENTS

JP 47-07791 A 3/1972

(Continued)

OTHER PUBLICATIONS

European Search Report mailed on Mar. 2, 2004.

*Primary Examiner*—Edward K. Look
*Assistant Examiner*—Michael Leslie
(74) *Attorney, Agent, or Firm*—Rader, Fishman & Grauer PLLC

(57) ABSTRACT

The lubrication between a shoe and a shoe pocket is improved without having to perform a complicated forming process. In a swash plate compressor comprising a swash plate locked to a drive shaft, which rotates together with the drive shaft, a shoe 31 that slidably contacts the swash plate, a piston 13 slidably disposed within a bore defining a compression space and a shoe pocket 36 that is formed as an integrated part of the piston 13 and slidably fits with the shoe 31, a beveled portion 41 is formed at an edge of an opening at the shoe pocket 36. A recessed portion 40 of the shoe pocket 36 is formed so as to achieve a constant curvature, whereas a projecting portion 32 of the shoe 31 is formed so as to achieve at least two different curvatures. The shoe pocket is designed so that a tangent point 46 of the recessed portion 40 and the beveled portion 41 is set within a strip range 45 over which the projecting portion 32 and the recessed portion 40 achieve contact with each other.

6 Claims, 5 Drawing Sheets

U.S. PATENT DOCUMENTS 6,688,212 B1 * 2/2004 Iizuka ..... 92/71

FOREIGN PATENT DOCUMENTS

JP 52-04190 A 3/1977
JP 54-38913 U 3/1979
JP 2001-248547 A 9/2001
JP 2001-280235 A 10/2001

* cited by examiner

SWASH PLATE COMPRESSOR

DESCRIPTION

This application is a U.S. National Phase Application under 35 USC 371 of International Application PCT/JP03/14566 filed Nov. 17, 2003.

TECHNICAL FIELD

The present invention relates to a swash plate compressor to be used in a cooling cycle or the like and more specifically, it relates to a structure to be adopted in an area where the swash plate is connected with piston.

BACKGROUND ART

In an example of the related art adopted in the area where the swash plate is connected to the piston in a swash plate type compressor, a recessed ball receiving portion at a shoe is made to contact the ball only at an intermediate position along the direction of the depth of the recessed ball receiving portion, to form a sealed oil reservoir void space next to the ball under the contact position and to form a narrow clearance that opens to the outside next to the ball above the contact position and a through hole formed so as to pass through the circumferential wall of the shoe toward the oil reservoir void space (see Japanese Unexamined Utility Model Publication No. S 54-38913). This structure is considered to facilitate the supply of lubricating oil to the oil reservoir void space and to the narrow clearance and thus improve lubrication at the sliding portions.

In another example of the related art, at a shoe having a semispherical projecting portion, a semispherical convex surface which slides against a semispherical concave portion formed at a piston with a projecting surface of a rotating body resulting from the rotation around the axis of the shoe is formed with a circular arc drawn around a center offset from the axis of the shoe by a specific distance along the direction perpendicular to the axis (see Japanese Unexamined Patent Publication No. 2001-248547). The clearance created between the semispherical convex portion on the top side of the shoe and the semispherical concave portion by adopting this structure allows the lubricating oil to be supplied with ease to achieve an improvement in the lubrication at the sliding portions.

In the art disclosed in Japanese Unexamined Utility Model Publication No. S 54-38,913 mentioned above, gaps (i.e., the oil reservoir void space and the narrow clearance) are formed between the ball and the recessed ball receiving portion by allowing the recessed ball receiving portion to have a specific curvature which is different from that of a perfect sphere, as illustrated in FIGS. 2 to 4 in this publication 1. In the art disclosed in Japanese Unexamined Patent Publication No. 2001-248547, on the other hand, the void where the lubricating oil is collected is formed by adjusting the curvatures of both the shoe and the semispherical concave portion to predetermined degrees. However, there is a problem in that it is difficult to form a shoe pocket that is equivalent to the recessed ball receiving portion or the semispherical concave portion described above and it therefore necessitates considerable technical expertise and high production costs to form the shoe pocket with an adjusted curvature such as that described above in reference to the related art.

Accordingly, an object of the present invention is to improve the lubrication between the shoe and the shoe pocket without necessitating a complicated forming process.

DISCLOSURE OF THE INVENTION

In order to achieve the object described above, the present invention provides a swash plate compressor comprising a swash plate fixed to a drive shaft, which rotates together with the drive shaft, a shoe that slidably contacts the swash plate, a piston that is slidably disposed inside a bore defining a compression space and a shoe pocket that is formed as an integrated part of the piston and slidably fits with the shoe, characterized in that a beveled portion is formed at an edge of an opening of the shoe pocket.

In this structure, lubricating oil can be taken in with ease through the beveled portion formed at the shoe pocket and, as a result, the lubricating oil can be supplied into a space between the shoe pocket and the shoe in sufficient quantity to improve the slidability and the wear resistance. Furthermore, the shoe pocket edge can be beveled with ease when forming and machining the shoe pocket and there is another advantage achieved by forming such a beveled portion in that it inhibits formation of a burr at the shoe pocket edge.

In addition, it is desirable that a recessed portion of the shoe pocket, at which the shoe is received, be formed so as to achieve a specific curvature, that a projecting portion of the shoe, which faces opposite the recessed portion, be formed so as to achieve at least two different curvatures and that the tangent point at which the beveled portion and the recessed portion achieve contact with each other be set within a range over which the projecting portion and the recessed portion achieve contact with each other.

In the structure described above, while the projecting portion of the shoe is formed to achieve at least two different curvatures, the recessed portion at the shoe pocket is formed so as to achieve a specific constant curvature (so as to be a true sphere). This difference between the shapes of the shoe and the shoe pocket keeps the shoe and the shoe pocket from achieving full contact over the entire range when they are fitted with each other and instead, the shoe and the shoe pocket achieve contact with each other over a narrow strip when the shoe slides inside the shoe pocket as the swash plate rotates. In the structure described above, the tangent point (tangential line) of the recessed portion and the beveled portion at the shoe pocket is set within the range of the strip so as to allow the lubricating oil to be taken in more efficiently through the beveled portion.

Moreover, it is desirable to constitute the beveled portion with a curved surface achieving a constant curvature which is smaller than the curvature of the recessed portion.

Such a structure can be achieved by first machining the shoe pocket to a predetermined depth so as to achieve a spherical shape having a predetermined radius of curvature in the recessed portion and then beveling the end of the opening at the recessed portion so as to achieve a spherical shape with a curvature smaller than that of the recessed portion (so as to achieve a larger radius). By adopting this method, the forming process is simplified.

The beveled portion may assume a shape other than that described above, and the advantages described above can be achieved with a beveled portion having a curved surface with at least two different curvatures or with a beveled portion having a flat surface.

In addition, it is desirable that the tangential line of the recessed portion and the tangential line (plane) of the beveled portion form an angle equal to or smaller than 45° at the tangent point of the recessed portion and the beveled portion.

When the angle formed by the tangential lines is 45° or less, the lubricating oil can be held in the void space defined with the beveled portion in a desirable manner and, as a result, the lubrication is improved even more effectively.

BEST MODE FOR CARRYING OUT THE INVENTION

Figure 1:
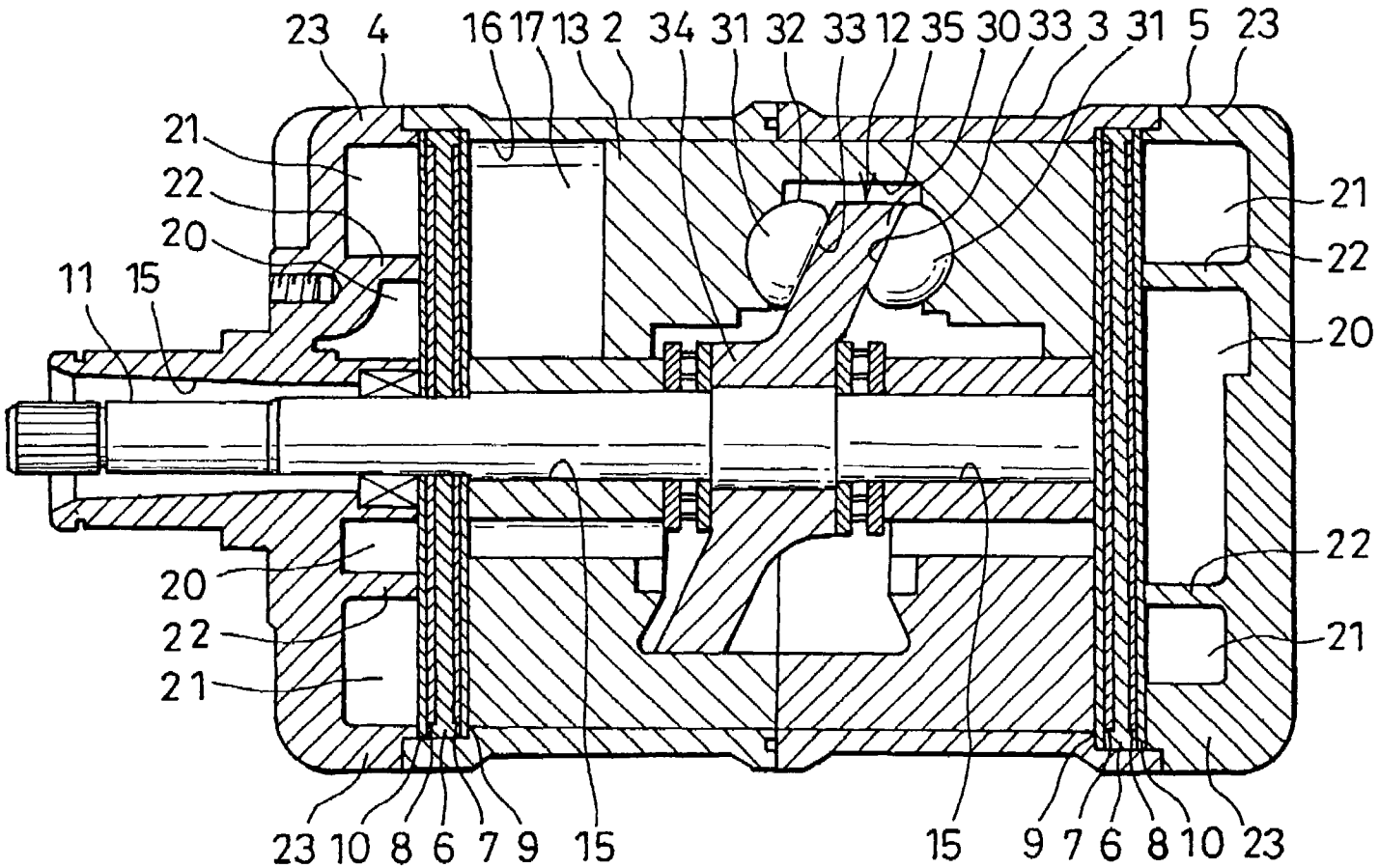
FIG. 1 is a sectional view of the structure adopted in a swash plate compressor according to the present invention.

The following is an explanation of embodiments of the present invention, given in reference to the attached drawings. FIG. 1 shows a swash plate compressor 1 achieved in an embodiment, which is employed in a freezing cycle that uses a coolant as a working fluid and comprises a front-side cylinder block (hereafter referred to as a front block) 2, a rear-side cylinder block 3, a front-side cylinder head (hereafter referred to as a front head) 4, a rear-side cylinder head (hereafter referred to as a rear head) 5, valve plates 6, intake valves 7, discharge valves 8, gaskets 9 and 10, a drive shaft 11, a swash plate mechanism 12, a piston 13 and the like.

The front block 2 and the rear block 3 are linked with each other, and the front head 4 and the rear head 5 are respectively locked onto the front side (the left side in the figure) of the front block 2 and the rear side (the right side in the figure) of the rear block 3 with bolts (not shown) so as to seal off the end surfaces of the two cylinder blocks 2 and 3. Sets, each constituted of a gasket 9, an intake valve 7, a valve plate 6, a discharge valve 8 and a gasket 10 disposed in this order starting from the side toward the cylinder block 2 or 3 are held between the front block 2 and the front head 4 and between the rear block 3 and the rear head 5.

The drive shaft 11 is used to communicate the driving force imparted by an engine or a motor and is inserted through and supported rotatably at a bearing hole 15 formed at the front head 4, the front block 2 and the rear block 3. A plurality (e.g., five) of bores 16 are formed over equal intervals on the circumferences of the front block 2 and the rear block 3 ranging around the drive shaft 11, and a double headed piston 13 is slidably disposed inside each bore 16. The piston 13 connects with a swash plate mechanism 12 to be detailed later and is allowed to make reciprocal movement. Thus, a compression space 17, the volumetric capacity of which changes as the piston 13 moves, is defined inside each bore 16.

Intake chambers 20 and discharge chambers 21 are defined inside the front head 4 and the rear head 5. In the intake chambers 20, which are formed toward the centers of the cylinder heads 4 and 5 with barrier walls 22, the coolant is guided through specific passages from a low-pressure line of the freezing cycle, and the coolant having been guided to the intake chambers travels through the intake valves 7, the valve plates 6, the discharge valves 8 and intake ports (not shown) formed at gaskets 9 and 10 before it is taken into the compression spaces 17. The discharge chambers 21 which are defined further outward relative to the intake chambers 20 by the barrier walls 22 and an outer wall 23 are made to communicate with the high-pressure line of the cooling cycle via a specific passage. The coolant having been compressed at the compression spaces 17 travels through the discharge valves 8 set in an open state, the valve plates 6, the intake valves 7 and discharge ports (not shown formed at the gaskets 9 and 10 before it is discharged into the discharge chambers 21.

The swash plate mechanism 12 includes a swash plate 30 and shoes 31. The swash plate 30 is a member assuming a substantially disk-like shape and is locked to the drive shaft 11 with the shaft locking portion 34 located at a central area thereof so as to form an angle other than a right angle relative to the drive shaft 11. The shoes 31, which are substantially semispherical members each having a projecting portion 32 and a flat portion 33, are slidably locked near an edge of the swash plate 30 with the flat portion 33 facing opposite the swash plate 30 so as to slide freely as the swash plate 30 rotates and become displaced forward/backward (to the left/right in the figure) as the swash plate 30 rotates.

Figure 2:
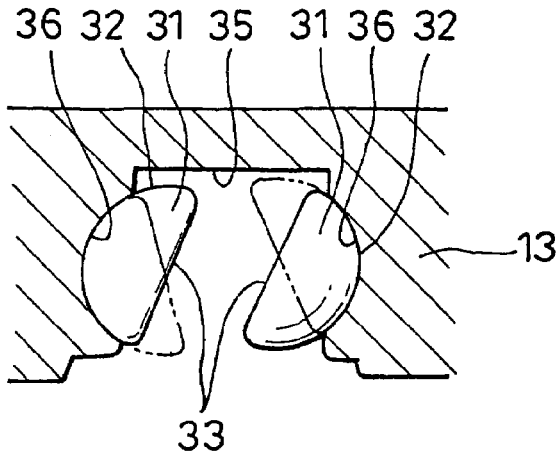
FIG. 2 is a partial enlargement, showing the connection of the shoe and the shoe pocket.

In addition, the pistons 13 each include shoe pockets 36 assuming a recessed shape and located at the inner wall toward the cylinder heads 4 and 5 at a hollow portion 35 defined therein, as shown in FIGS. 1 and 2, and the pistons 13 each move reciprocally as the corresponding shoes 31 become slidably fitted at the shoe pockets 36.

Figure 3:
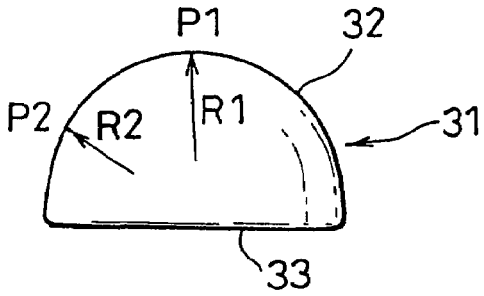
FIG. 3 illustrates the characteristics of the shape of the shoe.

The projecting portion 32 at each shoe 31 is formed so as to achieve at least two different curvatures and the curvature at a vertex P1 of the projecting portion 32 is different from the curvature at another point P2, as shown in FIG. 3. The projecting portion in the embodiment is designed so that when R1 represents the radius of curvature at the point P1 and R2 represents the radius of curvature at the point P2, the relationship expressed as R1>R2 is achieved.

Figure 4:
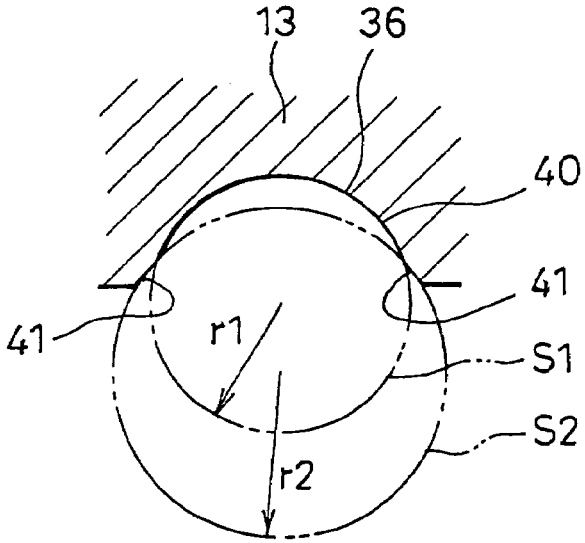
FIG. 4 illustrates the characteristics of the shape of the shoe pocket achieved in a first embodiment.

In addition, as shown in FIG. 4, the shoe pockets 36 are each constituted with a recessed portion 40 and a beveled portion 41. The projecting portion 32 of the shoe 31 is slidably received at the recessed portion 40, and its curvature is defined with a single circle of curvature S1. The beveled portion 41 is formed at the edge of the opening of the recessed portion 40, and has a curvature defined by a circle of curvature S2 having a larger radius of curvature than that of the circle of curvature S1 in the first embodiment. It is desirable that with r1 representing the radius of the circle of curvature S1 and r2 representing the radius of the circle of curvature S2, a relationship expressed as $r2/r1 \approx 1.1$ be achieved.

Figure 5:
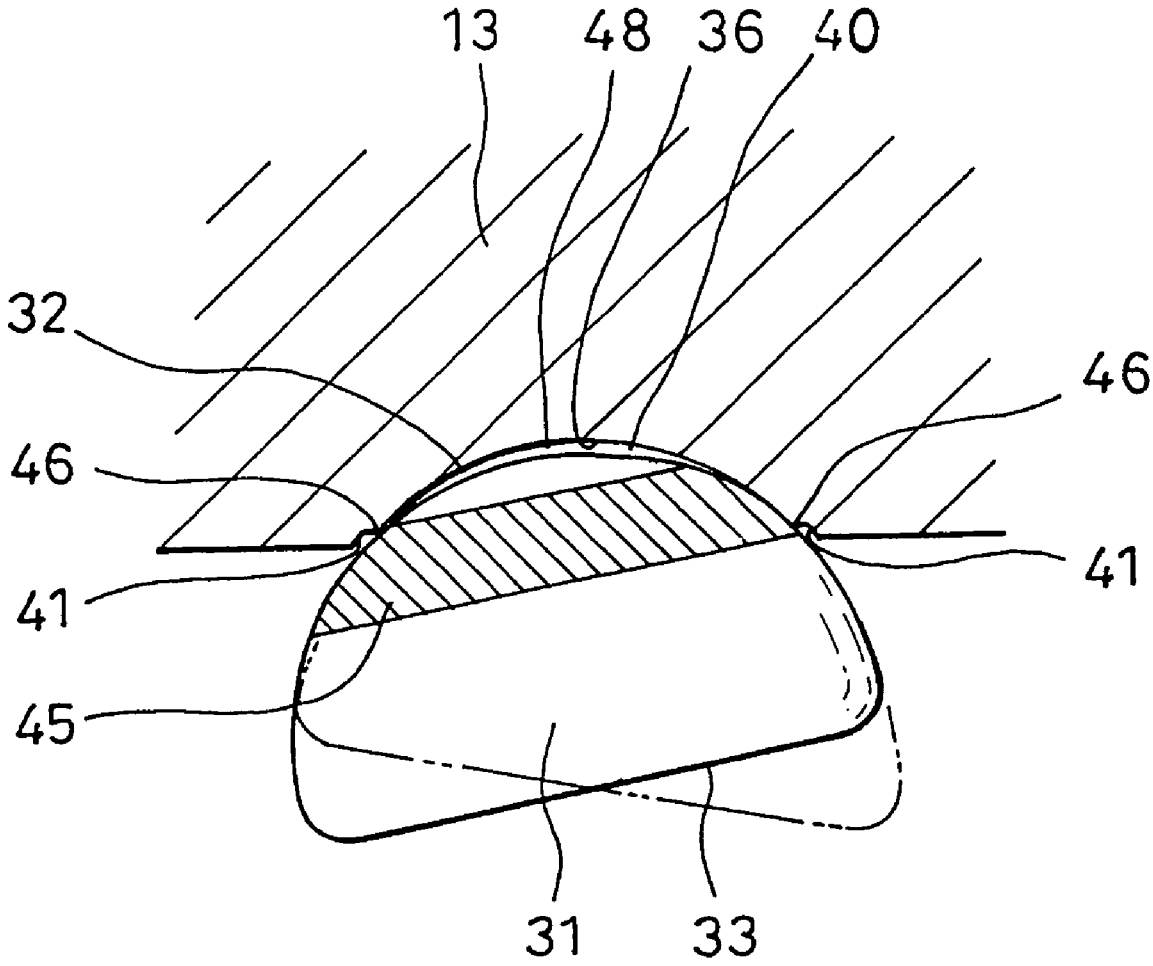
FIG. 5 illustrates the shoe sliding inside the shoe pocket.
Figure 6:
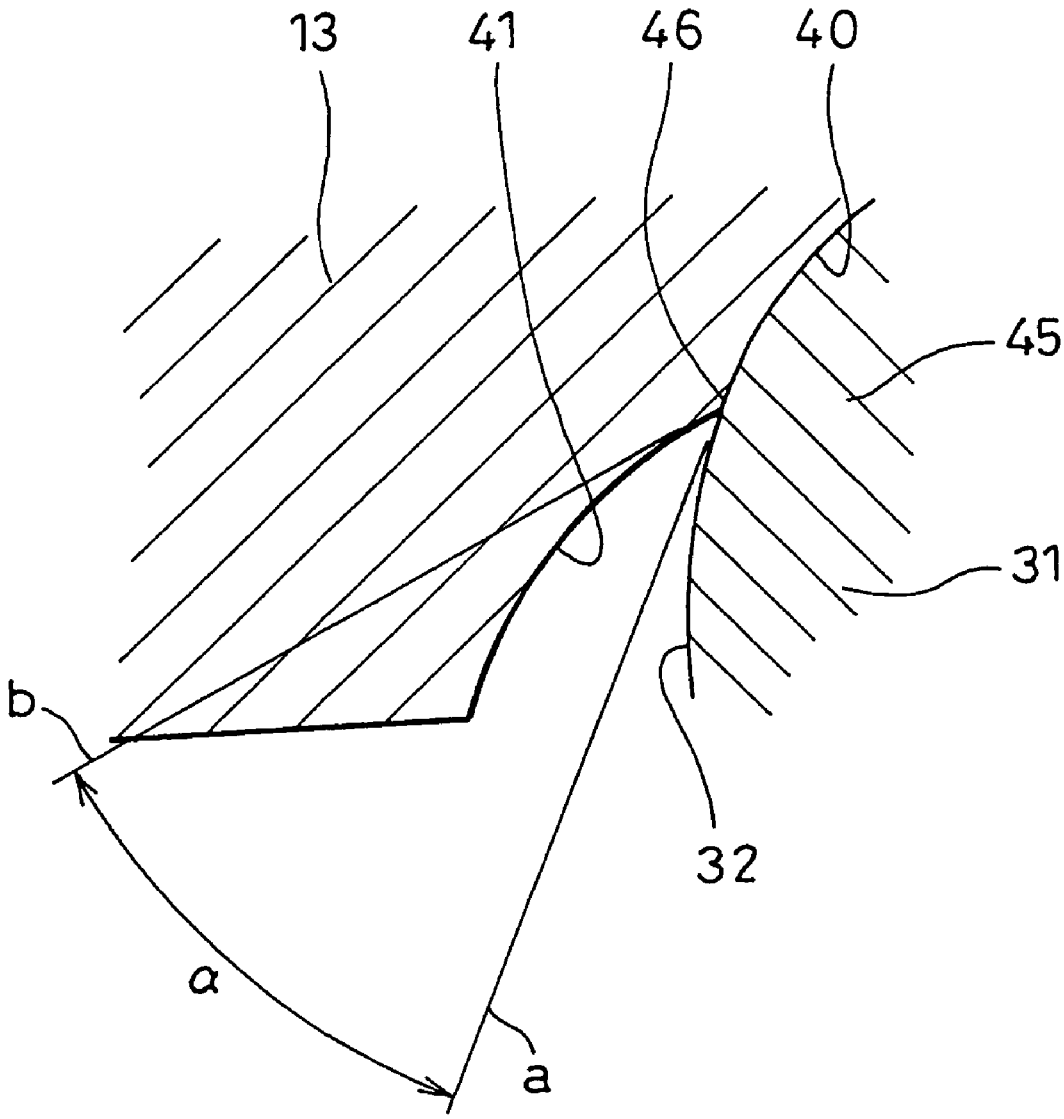
FIG. 6 shows the characteristics of the shape of the beveled portion achieved in the first embodiment.

As explained above, the projecting portion 32 at each shoe 31 achieves a plurality of curvatures and the recessed portion 40 at each shoe pocket 36 achieves a single curvature, and thus, a contact area 45 over which the shoe 31 and the shoe pocket 36 achieve contact during operation (when the piston 13 moves reciprocally) is a strip, as shown in FIG. 5. In addition, a tangent point 46 of the recessed portion 40 and the beveled portion 41 is set within the range of a contact area strip 45 and the angle $\alpha$ formed by a tangential line of the recessed portion 40 and a tangential line b of the beveled portion 41 at the tangent point 48 is set equal to or smaller than 45° in the structure, as shown in FIG. 6.

By adopting the structure described above, the beveled portion 41 formed at the edge of the opening of the shoe pocket 36 (the recessed portion 40) allows the lubricating oil to be easily taken into the space between the shoe 31 and the shoe pocket 36 and, as a result, better slideability and better wear resistance are achieved between the shoe 31 and the shoe pocket 36. Moreover, by setting different curvatures at the projecting portion 32 of the shoe 31 and at the recessed portion 40 of the shoe pocket 36, a void space 48 is formed between the shoe 31 and the shoe pocket 36, as shown in FIG. 5 so as to collect the lubricating oil at the void space 48 readily to further improve the lubrication. In addition, while the shoe 31 and the shoe pocket 36 achieve contact over the contact area strip 45 due to the different curvatures achieved at the shoe 31 and the shoe pocket 36, the beveled portion 41 is designed to remain within the contact area strip 45 at all times and, as a result, the lubricating oil can be taken in effectively through the beveled portion 41. The formation of such a beveled portion 41 achieves an added advantage in that no burr is formed during the forming process.

In the following explanation of other embodiments of the present invention given in reference to drawings, the same reference numerals are assigned to components identical to or similar to those in the first embodiment to preclude the necessity for a repeated explanation thereof.

Figure 7:
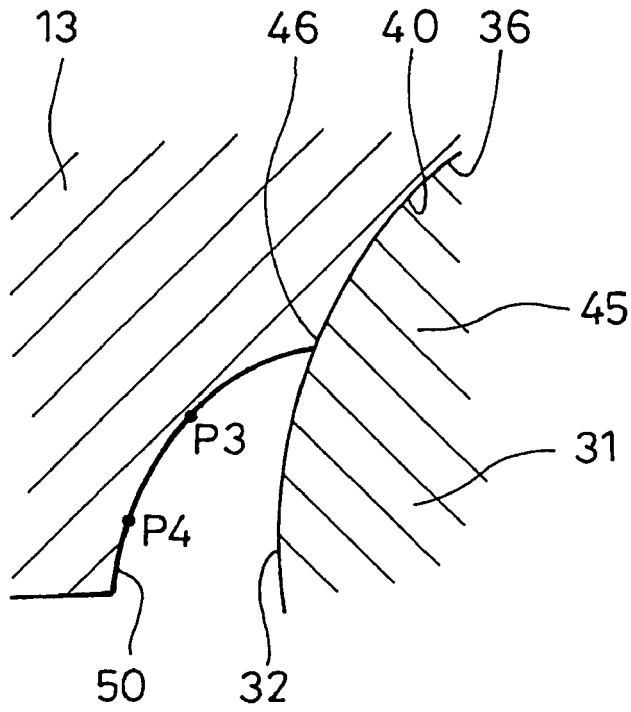
FIG. 7 shows the characteristics of the shape of the beveled portion achieved in a second embodiment.

The shoe pocket 36 shown in FIG. 7, which is achieved in the second embodiment, includes a beveled portion 50 constituted with a curved surface with a plurality of different curvatures, e.g., the curvatures at arbitrary two points P3 and P4 are different from each other. By adopting such a structure, too, the lubrication can be improved, as in the first embodiment, without greatly compromising the ease of formation.

Figure 8:
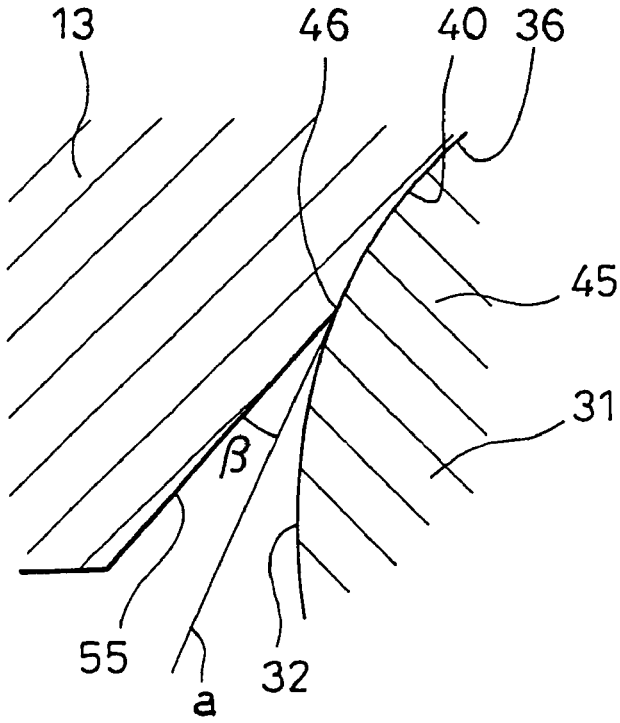
FIG. 8 shows the characteristics of the shape of the beveled portion achieved in the third embodiment.

A shoe pocket 36 in FIG. 8, which is achieved in the third embodiment, includes a beveled portion 55 constituted with a flat surface and designed so as to ensure that the angle β formed by a tangential line b of the recessed portion 40 and the beveled portion 55 at the tangent point 46 is equal to or smaller than 45°. By adopting such a structure, too, the lubrication can be improved, as in the first and second embodiments, without greatly compromising the ease of formation.

INDUSTRIAL APPLICABILITY

As described above, by adopting the present invention having beveled edges at the openings of the shoe pockets, the lubrication can be improved without complicating the forming process. In addition, by assuming specific characteristics in the shapes of the shoes and the shoe pockets and assuming a specific positional arrangement for the tangent point of the recessed portion and the beveled portion at the shoe pockets at a specific position, the lubricating oil can be taken in through the beveled portions with a high degree of effectiveness.

What is claimed is:

1. A swash plate compressor, comprising:

a swash plate locked to a drive shaft, which rotates together with said drive shaft;

a shoe that slidably contacts said swash plate;

a piston slidably disposed inside a bore defining a compression space; and a shoe pocket formed as an integrated part of said piston, which slidably fits with said shoe, characterized in;

that a beveled portion is formed at an edge of an opening at said shoe pocket;

that a recessed portion of said shoe pocket, at which said shoe is received is formed so as to achieve a constant curvature and a projecting portion of said shoe, which faces opposite said recessed portion, is formed so as to achieve at least two different curvatures; and that a tangent point of said beveled portion and said recessed portion is set within a range over which said projecting portion and said recessed portion achieve contact with each other.

2. A swash plate compressor according to claim 1, characterized in;

that said beveled portion is constituted with a curved surface achieving a constant curvature which is smaller than the curvature of said recessed portion.

3. A swash plate compressor according to claim 1, characterized in;

that said beveled portion is constituted with a curved surface having at least two different curvatures.

4. A swash plate compressor according to claim 1, characterized in;

that said beveled portion is constituted with a flat surface.

5. A swash plate compressor according to claim 2 or 3, characterized in;

that the angle formed by a tangential line of said recessed portion and a tangential line of said beveled portion at said tangent point is equal to or smaller than 45°.

6. A swash plate compressor according to claim 4, characterized in;

that the angle formed by a tangential line of said recessed portion and said beveled portion at said tangent point is equal to or smaller than 45°.

* * * * *